US010053275B2

(12) United States Patent
Pritchett et al.

(10) Patent No.: US 10,053,275 B2
(45) Date of Patent: Aug. 21, 2018

(54) DEFORMATION-RESISTANT CONTAINER WITH PANEL INDENTATIONS

(71) Applicant: GRAHAM PACKAGING COMPANY, L.P., York, PA (US)

(72) Inventors: Raymond A. Pritchett, Manchester, PA (US); Travis A. Hunter, Hellam, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 87 days.

(21) Appl. No.: 14/976,581

(22) Filed: Dec. 21, 2015

(65) Prior Publication Data

US 2016/0176605 A1 Jun. 23, 2016

Related U.S. Application Data

(60) Provisional application No. 62/095,580, filed on Dec. 22, 2014.

(51) Int. Cl.

| | |
|---|---|
| ***B65D 6/00*** | (2006.01) |
| ***B65D 79/00*** | (2006.01) |
| ***B65D 1/40*** | (2006.01) |
| ***B65D 1/02*** | (2006.01) |

(52) U.S. Cl.

CPC ..... *B65D 79/005* (2013.01); *B65D 1/0276* (2013.01); *B65D 1/40* (2013.01); *B65D 2501/0018* (2013.01); *B65D 2501/0036* (2013.01)

(58) Field of Classification Search

CPC ..... B65D 1/40; B65D 2501/0036; B65D 2501/0018

USPC ..... 215/381, 382, 383, 385

See application file for complete search history.

(56) References Cited

U.S. PATENT DOCUMENTS

| | | | |
|---|---|---|---|
| 5,139,162 | A | 8/1992 | Young et al. |
| 5,303,834 | A | 4/1994 | Krishnakumar et al. |
| 5,927,533 | A | 7/1999 | Payne et al. |
| 6,016,932 | A | 1/2000 | Gaydosh et al. |
| 6,257,433 | B1 | 7/2001 | Ogg et al. |

(Continued)

OTHER PUBLICATIONS

International Search Report and Written Opinion dated May 13, 2014 in International Application No. PCT/US14/11433.

(Continued)

*Primary Examiner* — Andrew T Kirsch

*Assistant Examiner* — Don M Anderson

(74) *Attorney, Agent, or Firm* — Baker Botts L.L.P.

(57) ABSTRACT

Plastic container has a container body having an outer surface and defining a longitudinal axis, at least one recessed panel defined in the container body having an outer perimeter and recessed relative to the outer surface of the container body, the perimeter including opposing longitudinal sides and transverse ends, a transition region defined along the perimeter of the recessed panel, the transition region extending between the recessed panel and the outer surface, and at least one indentation formed in the transition region proximate at least one transverse end of the outer perimeter, the indentation having a height, a width, and a depth, the height of the indentation extending beyond the transition region. The indentation can prevent or reduce container failure due to external forces, such as side loading during a hot-fill process.

27 Claims, 15 Drawing Sheets

(56) References Cited

U.S. PATENT DOCUMENTS

| | | | | |
|---|---|---|---|---|
| 6,662,960 | B2 | 12/2003 | Hong et al. | |
| 7,334,695 | B2 | 2/2008 | Bysick et al. | |
| 7,481,375 | B2 | 1/2009 | Hartney et al. | |
| 8,535,599 | B1 | 9/2013 | Lobbestael et al. | |
| 8,544,663 | B2 | 10/2013 | Barel et al. | |
| 8,556,621 | B2 | 10/2013 | Sequeira | |
| 8,561,822 | B2 | 10/2013 | Beck et al. | |
| 8,585,392 | B2 | 11/2013 | Barnes | |
| 8,632,867 | B2 | 1/2014 | Young et al. | |
| 8,636,944 | B2 | 1/2014 | Kelley et al. | |
| 2004/0161558 | A1* | 8/2004 | Gamel | B32B 27/20 428/35.7 |
| 2004/0164047 | A1 | 8/2004 | White | |
| 2005/0051509 | A1* | 3/2005 | Bysick | B65D 1/0223 215/381 |
| 2008/0047964 | A1 | 2/2008 | Denner et al. | |
| 2009/0242575 | A1 | 10/2009 | Kamineni et al. | |
| 2009/0266782 | A1 | 10/2009 | Lane | |
| 2010/0059532 | A1 | 3/2010 | Heisner et al. | |
| 2010/0072166 | A1 | 3/2010 | Dickie | |
| 2010/0176081 | A1 | 7/2010 | Kamineni et al. | |
| 2013/0001235 | A1* | 1/2013 | Patcheak | B65D 1/0276 220/609 |
| 2015/0314907 | A1* | 11/2015 | Kira | B65D 1/0223 215/383 |

OTHER PUBLICATIONS

International Search Report and Written Opinion dated Mar. 11, 2016 in International Application No. PCT/US15/67013.

* cited by examiner

SECTION A-A

SECTION B-B

SECTION A-A

DEFORMATION-RESISTANT CONTAINER WITH PANEL INDENTATIONS

CROSS REFERENCE TO RELATED APPLICATIONS

The present application claims priority to U.S. Provisional Application No. 62/095,580, filed on Dec. 22, 2014, the entire contents of which is incorporated herein by reference.

BACKGROUND

Technical Field

The presently disclosed subject matter relates generally to plastic containers, and more particularly to hot-fillable containers having discrete surface indentations configured to prevent permanent deformation.

Description of Related Art

Throughout the process of filling a plastic container, such as conventional hot-filled bottling techniques, the container is inherently subject external forces and to positive and negative pressures within the container. These forces and pressures can result in permanent deformation of the plastic material of the container, especially shortly after hot-filling the container, when the temperature of the plastic material is close to or above the glass transition temperature of the plastic material.

Various container configurations are known to permit temporary deformation at predefined locations on the container to compensate for negative pressure generated within the container due to cooling of the hot-filled contents after capping and sealing without permanent deformation of the container. For example, U.S. Pat. Nos. 5,303,834 and 7,334,695, each of which is hereby incorporated by reference herein in its entirety, disclose containers having recessed panels defined on the sidewalls of the containers. The recessed panels are configured to temporarily flex inwardly in response to negative container pressure, thereby reducing the volume of the container and eliminate a portion of the vacuum in the container. U.S. Pat. No. 7,334,695 discloses improvements in recessed panel design which permit vacuum compensation while also preventing permanent container bulging due to positive pressure during the filling process. Additionally or alternatively, and as disclosed in, for example, U.S. Pat. Nos. 6,662,960 and 7,481,375, each of which is hereby incorporated by reference herein in its entirety, one or more reinforcing ribs or grooves, such as horizontal ribs or grooves, may be defined in the container sidewall. Such ribs and grooves provide regions of increased radial stiffness to resist deformation of the container material beyond its plastic limit when subject to internal pressures and external loads.

However, consumer demand for packaged products is heavily influenced by aesthetic considerations of the packaging itself. Container design is therefore circumscribed by a need to provide containers having certain surfaces generally unencumbered by functional geometric features. Presently available plastic containers having pleasing surface aesthetics remain susceptible to permanent deformation during hot fill processing, handling and/or conveyance. Accordingly, there remains a continued need for improved, deformation-resistant plastic containers.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes plastic containers having one or more indentations defined in the surface thereof, the indentations located and configured to temporarily deform in response to an external load exerted on the surface of the container.

In accordance with the disclosed subject matter, a hot-fillable plastic container is provided including a container body having an outer surface and defining a longitudinal axis. At least one recessed panel is defined in the container body. The at least one recessed panel has an outer perimeter and is recessed relative to the outer surface of the container body, wherein the outer perimeter includes opposing longitudinal sides and transverse ends. A transition region is defined along the perimeter of the recessed panel, the transition region extending between the recessed panel and the outer surface. At least one indentation is formed in the transition region proximate at least one transverse end of the outer perimeter, the indentation having a height, a width, and a depth, the height of the indentation extending beyond the transition region.

As embodied herein, the indentation can be tapered such that the height, width, and depth of the indentation increase with increasing distance from the recessed panel to a maximum width and a maximum depth at the outer surface of the container body. The indentation is configured to temporarily deform when the plastic container is subject to an external load. Furthermore, the indentation can be located at or proximate to the midpoint of a transverse end of the outer perimeter. Furthermore, the indentation can be located the transition region proximate a longitudinal side of the outer perimeter. Methods of forming and filling such hot-fillable plastic containers are also disclosed herein.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION

Figure 1:
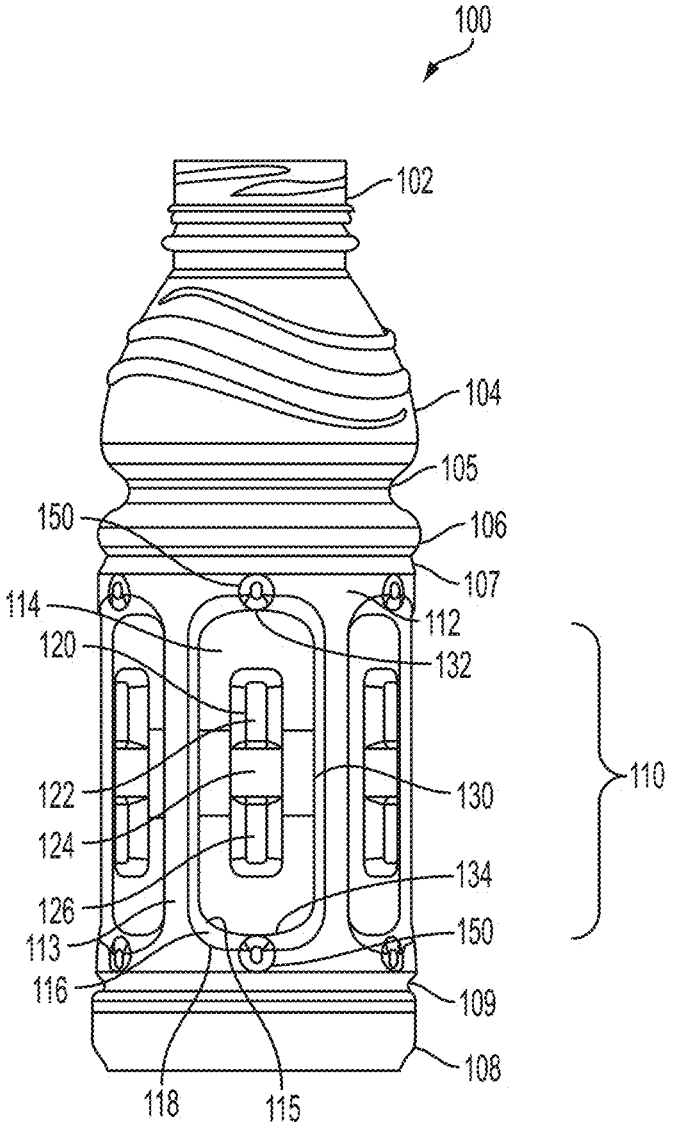
FIG. 1 is a schematic side view of an exemplary container in accordance with the disclosed subject matter.

Reference will now be made in detail to the various exemplary embodiments of the disclosed subject matter, exemplary embodiments of which are illustrated in the accompanying drawings. Methods of forming and filling or using the container of the disclosed subject matter will be described in conjunction with the detailed description of the container.

In accordance with the disclosed subject matter, a hot-fillable plastic container comprising a container body having an outer surface and defining a longitudinal axis, at least one recessed panel defined in the container body, the at least recessed one panel having an outer perimeter and recessed relative to the outer surface of the container body, the perimeter including opposing longitudinal sides and transverse ends, a transition region defined along the perimeter of the recessed panel, the transition region extending between the recessed panel and the outer surface, and at least one indentation formed in the transition region proximate at least one transverse end of the outer perimeter, the indentation having a height, a width, and a depth, the height of the indentation extending beyond the transition region is provided, The accompanying figures, where like reference numerals refer to identical or functionally similar elements throughout the separate views, serve to further illustrate various embodiments and to explain various principles and advantages all in accordance with the disclosed subject matter. Hence, features depicted in the accompanying figures support corresponding features and combinations thereof of the claimed subject matter.

Referring now to an exemplary embodiment of FIG. 1, for purpose of illustration only and not limitation, a hot-fillable plastic container 100 includes threaded neck 102, dome 104, shoulder 106, base 108, and container body 110. The dome region embodied herein is separated from the shoulder region by deep circumferential groove 105, while the shoulder region is separated from the container body by upper circumferential groove 107 and base is separated from container body by lower circumferential groove 109.

Container body 110 has an outer surface 112 and a plurality of recessed panels 114 defined therein. A plurality of posts 113 are defined on the outer surface 112 between adjacent recessed panels 114. Each recessed panel 114 contains a raised island 120 located substantially centrally on the recessed panel 114. In the embodiment depicted, each raised island 120 has an upper portion 122, middle portion 124, and lower portion 126, wherein middle portion 124 is formed as a generally horizontal rib. Upper portion 122 and lower portion 126 are substantially co-planar with outer surface 112 of container body 110 to help support a label mounted on the outer surface 112 of container body 110 if desired.

Recessed panels 114 are configured to flex inwardly in response to negative pressure within container 100 associated with cooling and contraction of the volume of the hot-filled liquid contents therein. Raised islands 120 increase the circumferential profile of the recessed panels 114, and can thereby limit outward expansion of the recessed panels 114 during pressurization of container 100 to prevent to prevent permanent outward deformation or barreling of the recessed panels. The raised islands and various alternative embodiments thereof are described in more detail in U.S. Pat. No. 7,334,695.

As depicted in the exemplary embodiment of FIG. 1, each recessed panel 114 has an outer perimeter 115. A transition region 116 extends between the outer perimeter 115 of recessed panel 114 and outer surface 112 of container body 110. As depicted, and as described further below with reference to the detail view of FIG. 5, transition region 116 generally has an inner surface region 117 and an outer surface region 118. Although the exemplary schematic depictions herein depict a plurality of discrete surface regions, it is to be understood that the boundaries of the regions as depicted are merely representations of contour and not edges. For example, one region can continue seamlessly into another. Additionally, the surface regions depicted herein are provided for purpose of representing depths of a three-dimensional surface in a two-dimensional representation. Thus, when a plurality of adjacent surface regions are depicted in side view, it will be understood that such surface regions can represent a single planar surface, a single curved surface, a complex contoured surface, or a combination thereof. Also, although only an inner surface region and an outer surface region are depicted for the transition region 116, more or fewer surface regions can be provided.

In the depicted embodiment, the recessed panels 114 are generally rectangular in side view. Hence, the perimeter of each recessed panel 114 has longitudinal sides 130 defined vertically along the longitudinal axis of the upright container and upper transverse end 132 and lower transverse end 134 defined horizontally along the transverse axis of the upright container.

In accordance with the disclosed subject matter, and as previously noted, at least one indentation is formed in the transition region, for example proximate at least one transverse end of the outer perimeter. Accordingly, in one aspect of the disclosed subject matter, at least one indentation 150 is defined in a surface of a container 100 extending radially between the outer surface 112 of the container 100 and a surface of the container 100 that is recessed relative thereto. The at least one indentation 150 has a height, a width, and a depth, and is oriented substantially vertically and substantially perpendicular to or tangential to the radially extending surface. The indentation 150 provides a region of greater flexibility and reduced rigidity relative to the radially extending surface to absorb stress exerted on the container by an external force. For example, and not by limitation, the exemplary embodiment of FIG. 1 includes indentations 150 defined at the midpoint of each upper transverse end 132 and lower transverse end 134. Each indentation 150 is generally a concave impression formed in the transition region 116 proximate the transverse ends 132, 134, respectively. As depicted, each indentation 150 extends longitudinally beyond transition region 116.

Figure 5:
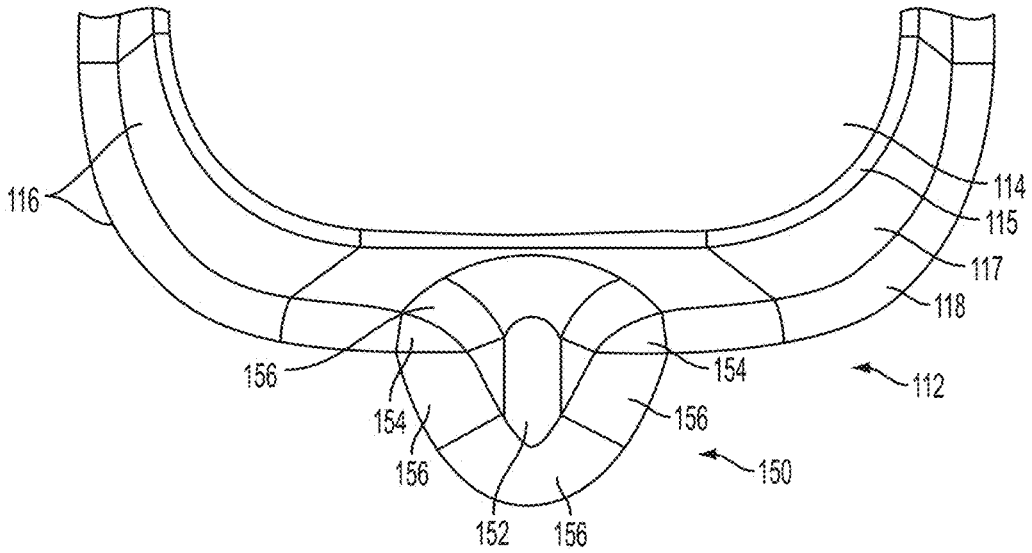
FIG. 5 is an enlarged schematic side view of an exemplary indentation and surface arrangement in accordance with the disclosed subject matter.

An exemplary indentation 150 is depicted in FIG. 5, for purpose of illustration and not limitation. In the exemplary embodiment depicted, indentation 150 is generally tapered in shape, with a maximum depth and maximum width in the inner surface region of the transition region proximate the outer perimeter of the recessed panel. Furthermore, for illustration only, the indentation is depicted with a plurality of surface regions. As noted with regard to the transition region, each surface region is depicted by contour lines; however, it is understood that adjacent surface regions can continue seamlessly without discrete edges. As depicted in FIG. 5, each surface region extends generally inwardly toward an interior of the container and can be provided with a planar, curved, or complex contour as suitable. For example, the surface region of the indentation 150 extending beyond transition region 116 can be defined generally as a concave surface 152 having a radius of curvature. As depicted, substantially planar surfaces 154 can be defined adjacent to concave surface 152, with discrete intermediate surfaces 156 extending between concave surface 152 and outer surface 112 of the container body 110 and transition region 116. Intermediate surfaces 156 are also defined between the planar surface 154 and the outer surface 112 of container body 110 and transition region 116. As noted, however, these surfaces, depicted as discrete regions, can also be embodied as one or more contoured surfaces or as one or more surface regions that transitions between substantially planar to curved surfaces.

Conventional container configurations generally have surface regions with high rigidity to provide, for example, grippable surfaces, top load strength, and limited sidewall buckling. However, contact between laterally adjacent containers at these regions of high rigidity, and particularly extended contact between multiple containers squeezed against each other during the hot-fill process, can cause commercially unacceptable localized deformation or warping of the outer surface of the container at these regions of contact. The indentations of the disclosed subject matter are configured to absorb container stress exerted by external forces such as adjacent containers and contact with the side rails of container filling lines. The indentations thus can reduce localized container stress between the transition regions and adjacent outer surface. Stress can be distributed to a greater extent, lowering peak stress at regions of contact with adjacent containers. For example, the curved surface of the indentations extending beyond the transition region can be configured to resist permanent outward deformation, and thus bias the indentation to return to its initial configuration when pressure in the container is reduced.

Figure 2:
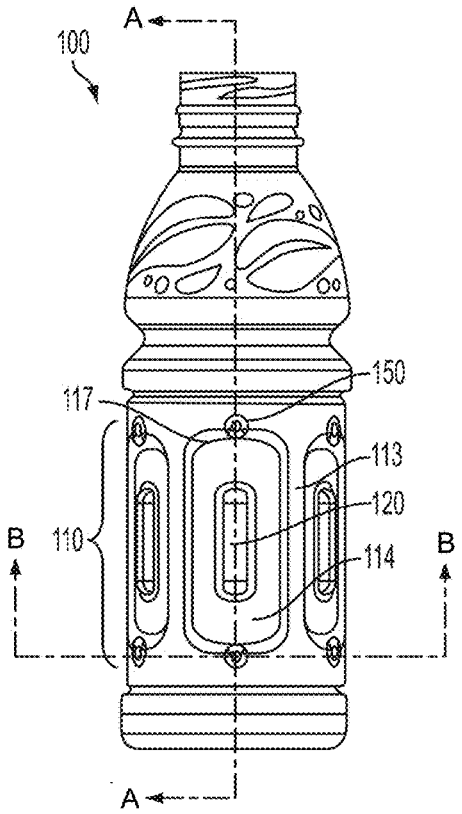
FIGS. 2, 2A, and 2B are, respectively, a schematic side view, a cross-sectional side view at Section A-A in FIG. 2, and a cross-sectional plan view at Section B-B in FIG. 2, of an exemplary container embodiment.
Figure 2A:
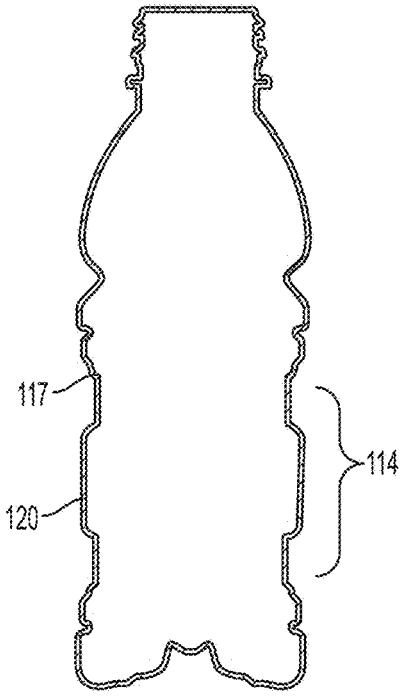
Figure 2B:
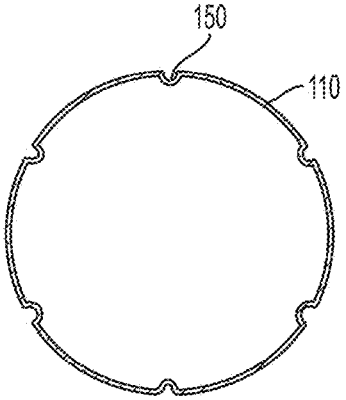
Figure 3:
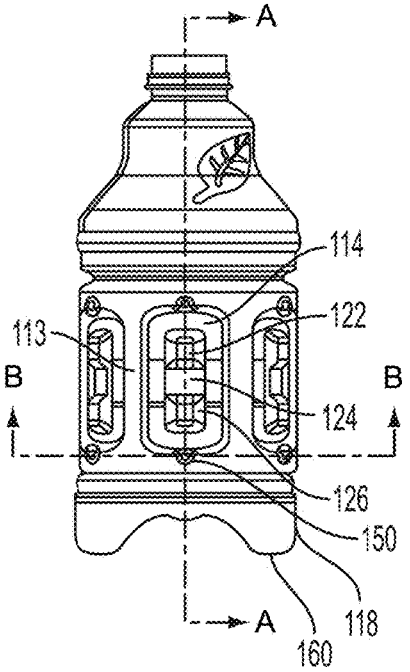
FIGS. 3, 3A, and 3B are, respectively, a schematic side view, a cross-sectional side view at Section A-A of FIG. 3, and a cross-sectional plan view at section B-B of FIG. 3 of an exemplary container embodiment.
Figure 3A:
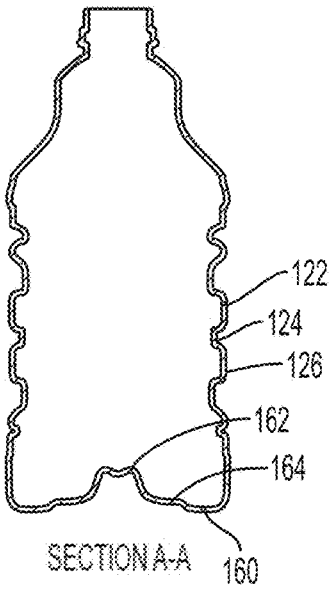
Figure 3B:
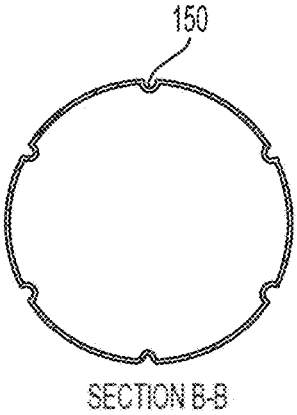
Figure 4:
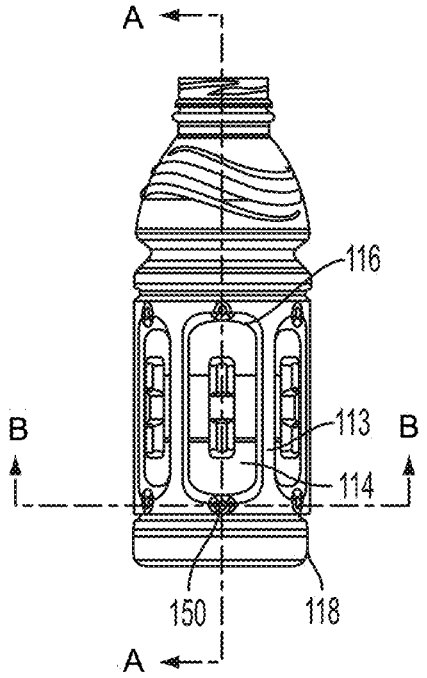
FIGS. 4, 4A, 4B, and 4C are, respectively, a schematic side view, a cross-sectional side view at Section A-A of FIG. 4, a cross-sectional plan view at Section B-B of FIG. 4, and a bottom view of an exemplary container embodiment.
Figure 4A:
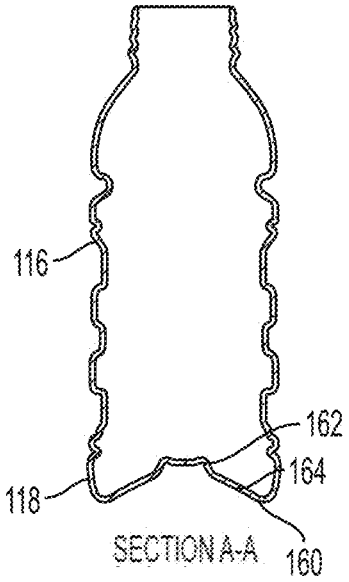
Figure 4B:
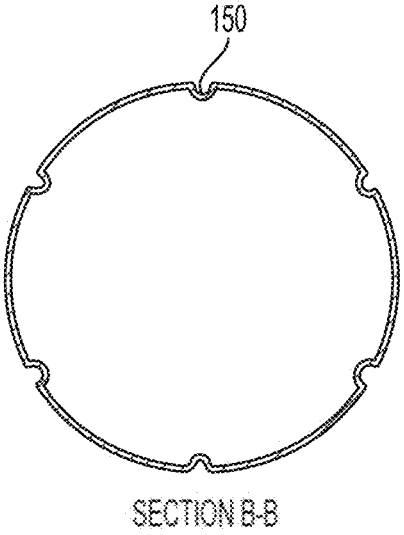
Figure 4C:
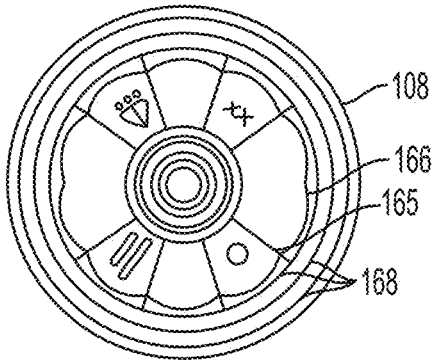

It is to be recognized that the overall shape and dimensions of the indentation, as well as the relative proportions of the container will vary according to the size and intended use of the container. For example, while a generally cylindrical container is illustrated herein, one of ordinary skill will recognize that the size and shape of container can be modified and the disclosed subject matter is not so limited. FIGS. 2, 2A and 2B, FIGS. 3, 3A and 3B, and FIGS. 4, 4A and 4B, respectively, depict a non-limiting exemplary embodiment of a container in accordance with the disclosed subject matter. FIGS. 2, 3, and 4 provide a schematic side view of three exemplary container embodiments, while FIGS. 2A, 3A, and 4A provide corresponding cross-sectional side views, and FIGS. 2B, 3B, and 4B provide corresponding cross-sectional plan views. FIG. 4C is a schematic bottom view of the exemplary container embodiment of FIG. 4.

For purpose of illustration only, the dimensions of the indentations and the corresponding container volume and diameter of the exemplary embodiments of container 100 as depicted in FIGS. 2, 3, and 4, respectively, are summarized in Table 1 below.

TABLE 1

Dimensions of Indentations of Exemplary Container Embodiments

| | | | | |
|---|---|---|---|---|
| Container | Volume (Ounces) | 15.2 | 10 | 64 |
| | Diameter (Inches) | 2.627 | 2.276 | 4.6 |

TABLE 1-continued

| Dimensions of Indentations of Exemplary Container Embodiments | | | | |
|---|---|---|---|---|
| Indentations | Maximum Depth (Inches) | 0.158 | 0.111 | 0.233 |
| | Maximum Height (Inches) | 0.304 | 0.206 | 0.34 |
| | Maximum Width (Inches) | 0.32 | 0.19 | 0.379 |

The dimensions above are provided for illustration only, and not limitation. Generally, the depth of the indentations can be between about 0.025 inches and about 0.350 inches, or between about 0.1 inches and about 0.3 inches; the height of the indentations can be between about 0.05 inches and about 0.5 inches, or about 0.15 inches and about 0.4 inches; and the width of the indentations can be between about 0.05 inches and about 0.5 inches, or between about 0.15 inches and about 0.4 inches. In embodiments when the indentations are substantially tapered, such as depicted in FIG. 5, the dimensions above refer to the maximum width and/or maximum depth of the indentations.

One consideration in determining a dimension of an indentation in accordance with the disclosed subject matter is a corresponding dimension of container as a whole. In certain embodiments, the ratio of the maximum depth of the indentation to the maximum radius of the container is between about 0.075 and about 0.15; the ratio of the maximum height of the indentation to the height of the container is between about 0.05 and about 0.15; and the ratio of the maximum width of the indentation to the maximum radius of the container body is between about 0.10 to about 0.20.

In certain embodiments, however, a relevant consideration for determining a dimension of an indentation in accordance with the disclosed subject matter is a corresponding dimension of a particular portion of the container 100, such as the container body 110 or a panel recessed thereto (e.g., recessed panel 114). Thus, the ratio of the maximum width of an indentation 150 to the maximum width of a recessed panel 114 can be between about 0.1 and about 0.5, or between about 0.2 and about 0.4; and the ratio of the maximum depth of an indentation 150 to the depth between the outer surface 112 of the container body 110 and a recessed panel 114 therein can be between about 0.3 and about 1.0, or between about 0.5 and about 0.95. The ratio of the radius of curvature of indentation groove 152 to the radius of the container body can be between about 0.02 to about 0.06, or between about 0.025 to about 0.04.

In embodiments of the disclosed subject matter in which the container body 110 is separated from additional portions of the container, such as a base portion 108 or an upper dome 104 by a geometric feature, such as a circumferential groove 107, 109, the indentation 150 can extend over substantially the entire distance between the transition portion and the surface geometry feature, or can extend over a portion of said length.

In the exemplary embodiment depicted in FIG. 5, as well as those of FIGS. 2, 3, and 4, indentation 150 in side view defines a generally V-shape in the transition region. In alternative embodiments, indentation 150 can be provided with alternative shape in side view as suitable for the intended purpose, such as a generally U-shape. Likewise, the concave surface 152 of the indentation can have an arcuate surface in cross-section plan view, such as a U-shape, or can be another suitable shape as desired. In combination with surface 152, the indentation can thus define a V-shape in cross-section as depicted in FIGS. 2B, 3B, and 4B, for illustration and not limitation.

Additionally or alternatively, the indentation can be configured to temporarily flex or deform to relieve stress above a threshold load. For example, indentations can be configured to partially or completely fold in response to external pressure on the container after filling and sealing. For example, an indentation can deform by narrowing (e.g., folding) or by flattening (e.g., widening) depending on the direction of the local stress exerted relative thereto. By way of example, and without limitation to theory, a filled and sealed container squeezed between adjacent containers against a side rail of a container filling line would be subject to local container stress at the points of contact with the adjacent containers and the side rail. In response, the container will flex inwardly, increasing the pressure within the container. When the sum of internal and external pressures exceeds the elastic limit of the polymeric container material at a region of the container, the container material can crease. One or more indentations proximate to the adjacent containers can narrow or fold in response to the local external stress, while the remaining indentations if provided can flatten to alleviate a portion of the pressure in the container. Narrowing or folding of the indentation can result in a temporary decreased in the width of the indentation at the transition region. When the external load is removed, each indentation can return to its as-formed condition. Hence, in contrast to the deformation of the smooth sidewall observed in prior art containers, residual creasing, if any, of the indentations is either unnoticeable or commercially acceptable. Accordingly, as embodied herein, the indentation can be configured to fold inwardly in response to an external force on the outer surface of the container, and to reform substantially to its as-formed shape when the external force is removed. The indentation can therefore advantageously reduce or prevent permanent container creasing or deformation caused by external forces on the container. In particular, the indentation can reduce the susceptibility of the container to permanent deformation relative to an identical or substantially identical container that does not include an indentation as disclosed.

As embodied herein, for purpose of illustration, the transition portion proximate the transverse end 132, 134 of the perimeter is provided with a single indentation 150 at about the midpoint between longitudinal sides. It will be recognized, however, that alternative arrangements of transverse ends 132 and 134, can be provided—with and without indentations 150. For purpose of example and not limitation, only one of transverse end 132 or transverse end 134 can have an indentation 150; or, when more than one recessed panel 114 is provided, only alternating transverse ends 132 and 134 of adjacent panels can have an indentation 150. Likewise, although as depicted only one indentation 150 is provided in each transverse end 132, 134, two or more indentations 150 can be provided in one or both transverse ends 132, 134. Moreover, and as described below, one or more, or two or more, indentations 150 can additionally or alternatively be provided in one or both of the longitudinal sides 130 of one or more panels.

Although the various embodiments depicted herein are all substantially cylindrical containers, container can have any desired shape, provided that the container is susceptible to local deformation of the outer surface of the container body due to pressure exerted by adjacent containers during hot-fill processing and handling.

Although only generally rectangular recessed panels and corresponding transition regions are depicted herein, recessed panel can have any suitable shape, such as square, oval, circular, or polygonal. When the recessed panel and corresponding transition region is round, the indentations can be provided at the bottom and/or top of the transition region.

The cross-sectional side view of the base 108 of the exemplary container embodiments of FIGS. 2 and 3 is shown in FIGS. 2A and 3A, respectively. As shown, base 108 can have a standing surface 160, a frustroconical peak 162, and a diaphragm or wall 164 extending between the standing surface or peak. Diaphragm or wall 164 can have hinges defined therein to facilitate temporary or substantially permanent movement thereof. Diaphragm or wall 164 can be substantially rigid, or can be configured to flex in response to the weight of the contents of container 100 and/or in response to negative pressure in the container 100.

The base 108 of the exemplary embodiment of container 100 illustrated in FIG. 4 is shown in cross-sectional side view in FIG. 4A and bottom view in FIG. 4C. In the depicted embodiment, the standing surface 160 has a plurality of circumferential rings 168, and diaphragm or wall 164 is divided by a series of radial ribs 165. A circumferentially undulating transition region 166 is defined between standing surface 160 and diaphragm or wall 164. Base 108 is also etched on the diaphragm or wall 164 with various markings. It will be understood, however, that the disclosed subject matter is not limited to use in containers with the base designs depicted and described, but rather can be employed with any suitable base design.

The containers described herein can be formed from materials including, but not limited to, polyethylene terephthalate (PET), polyethylene naphthalate (PEN) and PEN-blends, polypropylene (PP), high-density polyethylene (HDPE), among others and combinations thereof. Furthermore, various additives or surfactants can be used, such as monolayer blended scavengers or other catalytic scavengers as well as multi-layer structures including discrete layers of a barrier material, such as nylon or ethylene vinyl alcohol (EVOH) or other oxygen scavengers.

In the exemplary embodiments of container 100 depicted herein, for illustration and not limitation, raised islands 120 are defined within the recessed panels 114. In the embodiments depicted in FIGS. 3 and 4, for example, the islands 120 have a raised upper portion 122 and lower portion 126 separated by a middle portion 124 formed as a horizontal rib. In embodiments of the disclosed subject matter in which raised islands 120 are provided on recessed panels 114, the islands 120 can be substantially centrally located on the recessed panels 114 and substantially co-planar with the outer surface 112 of the container body 110. If provided, the raised islands 120 can preferably cover a surface of the recessed panel 114 of about 10% or more. Certain embodiments in accordance with the disclosed subject matter do not contain raised islands 120.

Figure 6A:
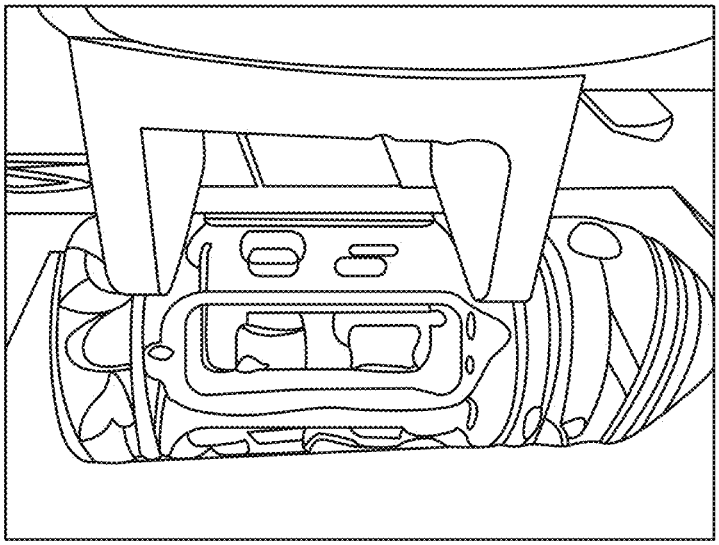
FIG. 6A is a photograph of a side load container deformation testing apparatus during island side load testing of an exemplary container in accordance with the disclosed subject matter.
Figure 6B:
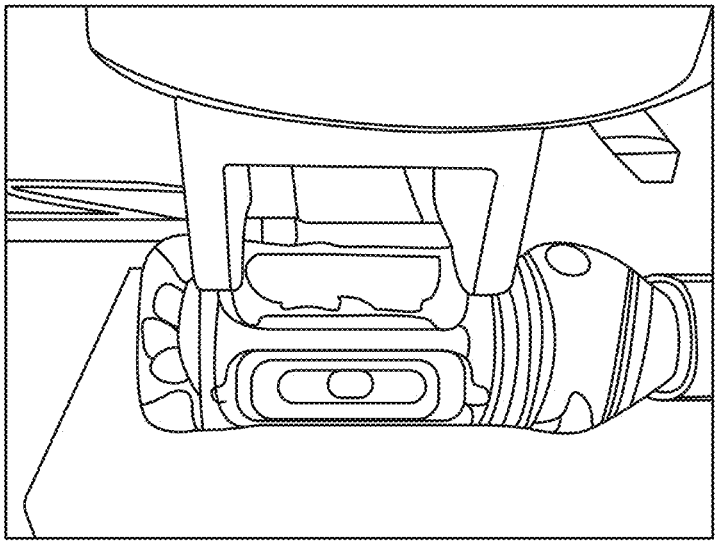
FIG. 6B is a photograph of a side load container deformation testing apparatus during post side load testing of an exemplary container in accordance with the disclosed subject matter.

Based upon the above containers in accordance with the disclosed subject matter herein can be provided with improved load performance relative to containers of similar configuration but without indentations of the disclosed subject matter. For purpose of comparison, fifty samples each of a conventional container and container 100 as illustrated in FIG. 1 and a container of similar configuration but without the indentation of the disclosed subject matter (i.e., "control containers") were produced. The sample containers were subject to side load after hot-filling and sealing, and subsequently visually inspected for visible container failure (i.e., permanent deformation). The temperature of the filled and sealed containers was approximately 72° F. at the time of testing. Each filled and sealed container was placed on its side in a platform with a groove configured to hold the container in place. Twenty-five of the control container samples and twenty-five of the samples of container 100 were placed in the platform groove such that a raised island was aligned in the test fixture for island side load testing as depicted in FIG. 6A. The remaining twenty-five control containers and samples of container 100 were aligned such that a post defined between adjacent recessed panels was aligned vertically in the test fixture for post side load testing as depicted in FIG. 6B. Pressure was then applied vertically from above to the outer surface of the container body using a mechanical press equipped with projections aligned to the outer surface of the container body above and below the recessed panels.

The testing was performed on an Instron® top load machine programmed to provide panel extension of 0.250 inches at a speed of 2 inches per minute. Side load testing of a container 100 above and below a raised island 120 ("island side loading") is depicted in FIG. 6A, and side load testing of a container 100 above and below a post 113 ("post side loading") is depicted in FIG. 6B. The depicted fixture used for the side load testing was designed to simulate the side rails on a container filling line. During container filling, containers can be forced against the narrow side rails on a container filling line at high pressure exerted by as many as several hundred adjacent containers on the filling line. The side rails of the container filling line can therefore be a source of side load causing container denting.

The load exerted during each testing run was recorded, as was the resulting distance of extension of the recessed panels from their as-formed location on the container. Each sample container was inspected visually for visible container failure (i.e., permanent deformation). It was observed that 5 out of 25 (20% of) control containers and just 1 out of 25 (4% of) containers 100 subject to island side load exhibited visible container failure. 20 out of 25 (80% of) control containers subject to post side load exhibited visible container failure, while 10 of the 25 (40% of) containers 100 subject to post side load exhibited visible container failure. These results demonstrate that the indentations as disclosed and as generally embodied herein can significantly reduce container failure due to side load.

Figure 7A:
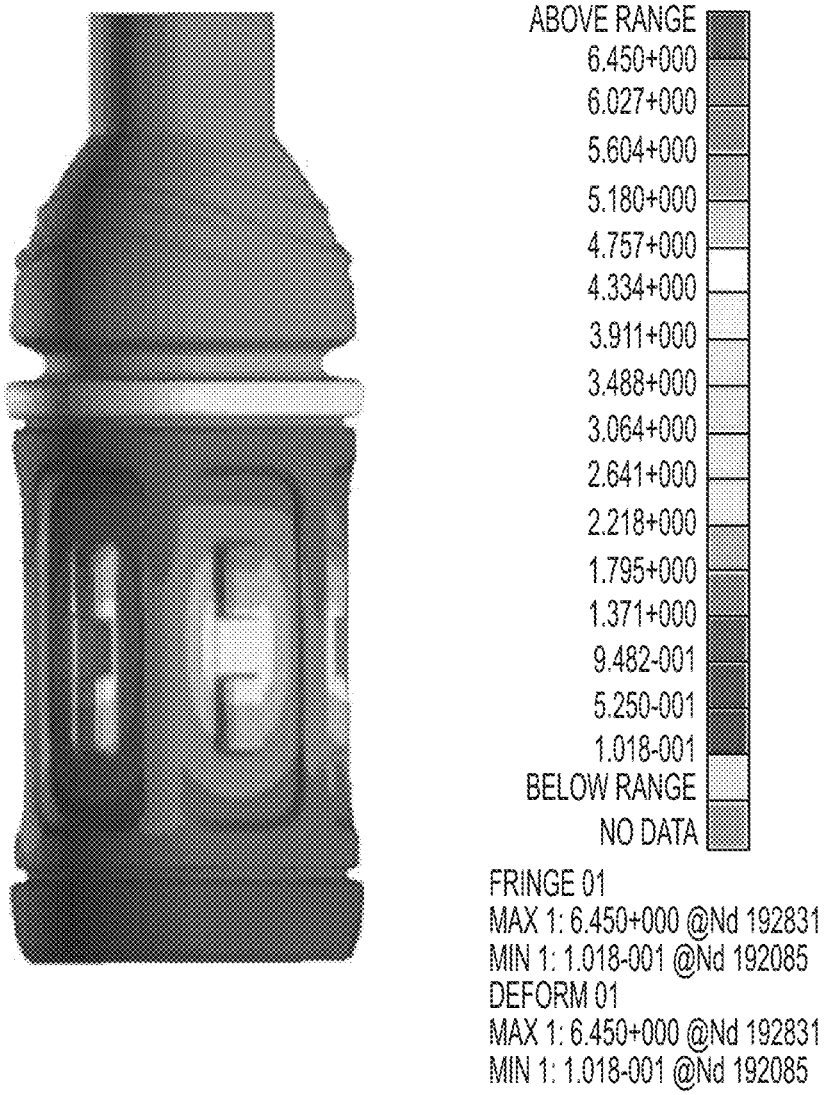
FIG. 7A is an illustration of deformation observed with finite element analysis of a container having no indentations of the disclosed subject matter under simulated fluid-filled conditions with top load.
Figure 7B:
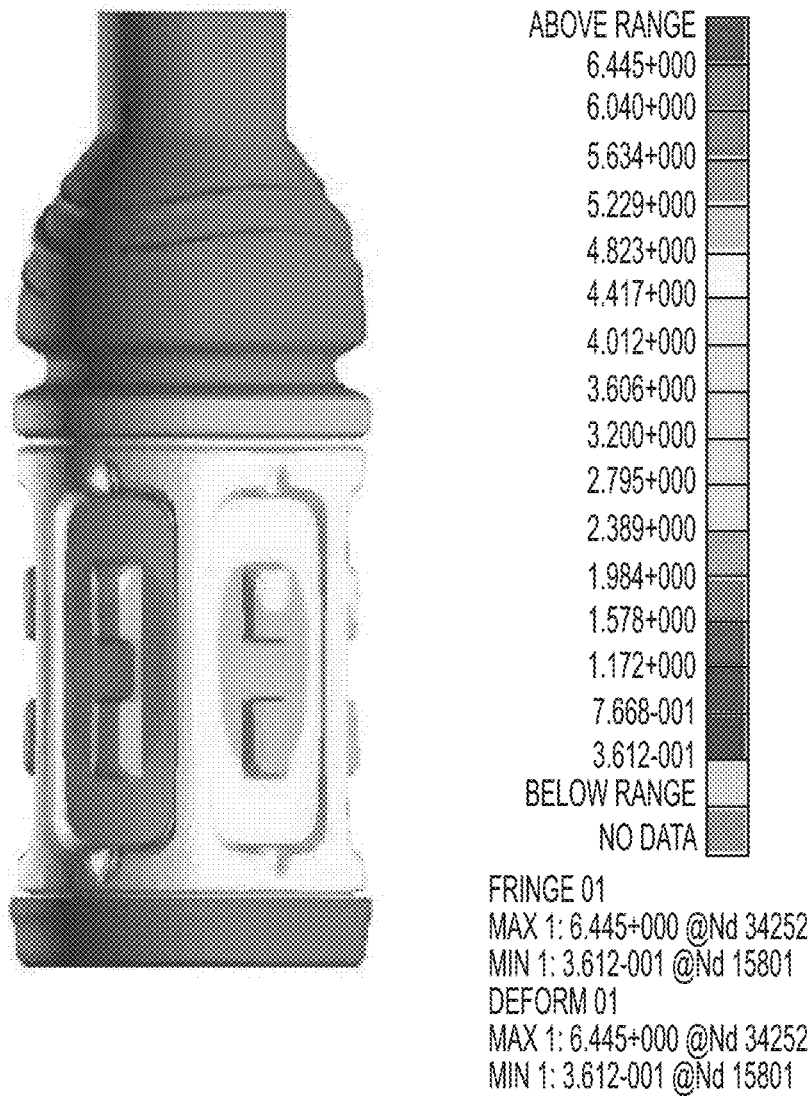
FIG. 7B is an illustration of deformation observed with finite element analysis of an exemplary container of similar configuration as depicted in FIG. 7A, but with indentations in transverse ends of panels of the container, in accordance with the disclosed subject matter, under simulated fluid-filled conditions with top load.

To demonstrate if filled containers having indentations as described herein would not exhibit impaired top-load strength, finite element analysis (FEA) simulations were conducted with a control container and with container 100 as depicted in FIG. 1. The embodiment of FIG. 1 differed from that of the control container by including indentations as described above, as well as having a slightly revised base, which is not believe to impact top loading capabilities. FEA fluid-filled top-load simulation results for the control container and container 100 are shown in FIG. 7A and FIG. 7B, respectively. Both the control container (i.e., with no indentations) and container 100 exhibited satisfactory top load strength. Top load performance was also confirmed by subjecting 10 sample control container and 10 sample containers 100 to top load with a mechanical press. Each container was placed upright under a flat mechanical press and top load was applied. The force applied and extension observed were recorded. None of tested sample control containers and containers 100 exhibited visible container failure.

Figure 8:
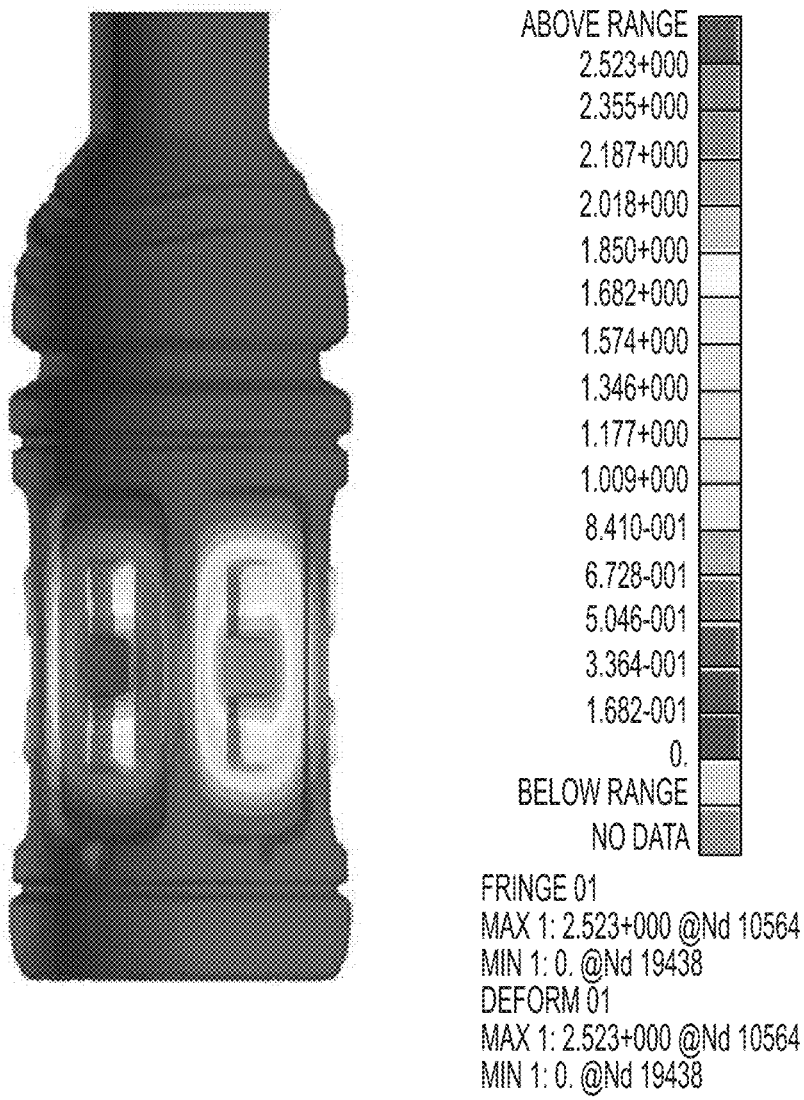
FIG. 8 is an illustration of deformation observed with finite element analysis of an exemplary container in accordance with the disclosed subject matter under simulated conditions of container vacuum due to hot filling and cooling.

To confirm that filled containers having indentations as disclosed properly compensate for internal vacuum after hot-filling, sealing, and cooling, FEA fluid-filled simulation was conducted using a container having indentations formed in the transition region proximate to the upper and lower transverse ends of the perimeter. The simulated container and FEA results are provided in FIG. 8. Full vacuum conditions were reached in the simulation without failure of the container.

Figure 9:
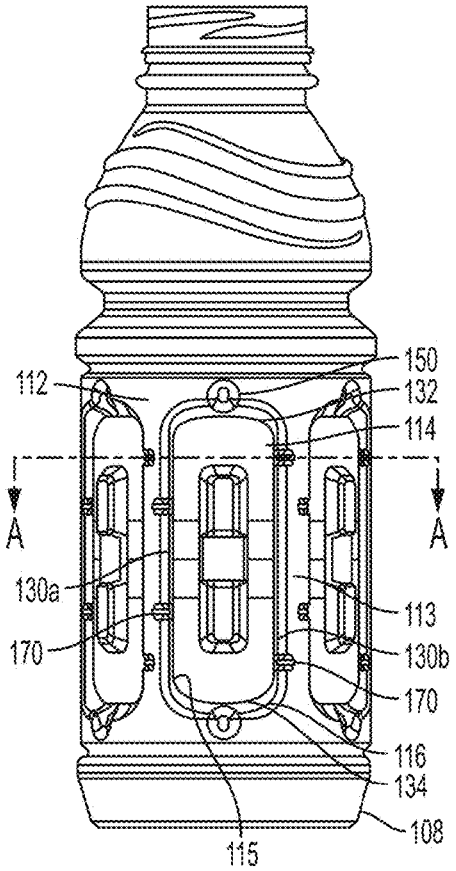
FIGS. 9 and 9A are, respectively, a schematic side view and a cross-sectional plan view at Section A-A of FIG. 9 of another exemplary container embodiment in accordance with the disclosed subject matter.
Figure 9A:
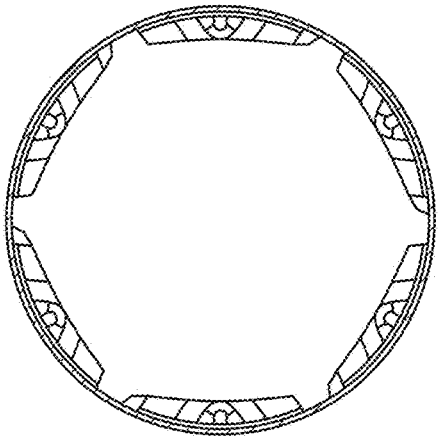

As previously noted, the disclosed subject matter contemplates various configurations or arrangements of the disclosed indentations. For example, another embodiment of a container in accordance with the disclosed subject matter is provided in FIG. 9 for the purpose of illustration and not limitation. As embodied herein, indentations 150 are defined at midpoints of both the upper and lower transverse ends 132, 134 of the recessed panels as previously described in detail above. As depicted in FIG. 9, indentations 170 are additionally defined in the longitudinal sides 130*a*, 130*b* of the recessed panels, each indentation in the longitudinal side having a configuration as described above with regard to the transverse end.

Further in accordance with the disclosed subject matter, at least one such indentation can be formed in the transition region proximate at least one longitudinal side of the outer perimeter of the recessed panels. Indentations formed proximate a longitudinal side of the recessed panel can extend perpendicular to a longitudinal axis defined by the container (e.g., horizontally when the container is in its upright orientation).

As further depicted, in the exemplary embodiment depicted in FIG. 9, two indentations 170 are defined in each of the longitudinal sides 130*a*, 130*b* of the recessed panel 114. In alternative embodiments, a single indentation 170 can be defined in each longitudinal side 130*a*, 130*b*, or a single indentation 170 can be provided in only one of longitudinal sides 130*a*, 130*b* defined at the perimeter of a recessed panel 114.

Indentations 170 can be disposed symmetrically on opposing longitudinal sides 130*a*, 130*b* of recessed panels 114 or in an asymmetric arrangement. In the exemplary embodiment depicted in FIG. 9, indentations 170 are provided in staggered arrangement such that indentations 170 defined in longitudinal side 130*a* are defined more proximal to the midpoint of the longitudinal sides between transverse ends 132, 134 than are indentations 170 in longitudinal side 130*b*. In alternative embodiments, however, and as noted above, indentations 170 can be disposed symmetrically such that the indentations on opposing longitudinal sides 130*a*, 130*b* of the recessed panels are aligned.

Furthermore, the arrangement of indentations 170 can be varied between respective recessed panels 114. For example, one or more indentations 170 can be defined at corresponding locations in each longitudinal side 130*a*, 130*b* of a first recessed panel or series of recessed panels, and defined at a second corresponding location in each longitudinal side 130*a*, 130*b* of a second recessed panel or series of recessed panels. Accordingly, in certain embodiments, a first arrangement of respective locations of indentations 170 is provided in a first series of recessed panels, and a second arrangement of respective locations of indentations 170 is provided in a second series of recessed panels, such that the first series of recessed panels alternates in succession with the second series of recessed panels around the circumference of the container.

In accordance with another aspect, indentations in the longitudinal sides of a panel 170 can have a height a width, and/or a depth that are proportionately smaller than the height, width, and depth of indentations in the transverse ends of the panel 150 as disclosed above, and/or a radius of curvature proportionately greater than the radius of curvature of indentations 150 as disclosed above.

Figure 10B:
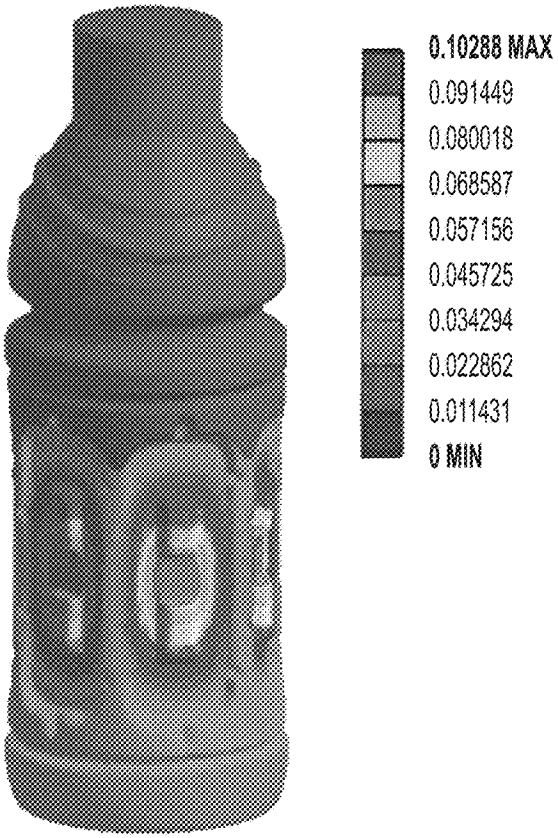
FIG. 10B is an illustration of deformation observed with finite element analysis of an exemplary container of similar configuration as depicted in FIG. 10A, but with additional indentations in longitudinal sides of panels of the container, in accordance with the disclosed subject matter, under simulated conditions of container vacuum due to hot filling and cooling.
Figure 10A:
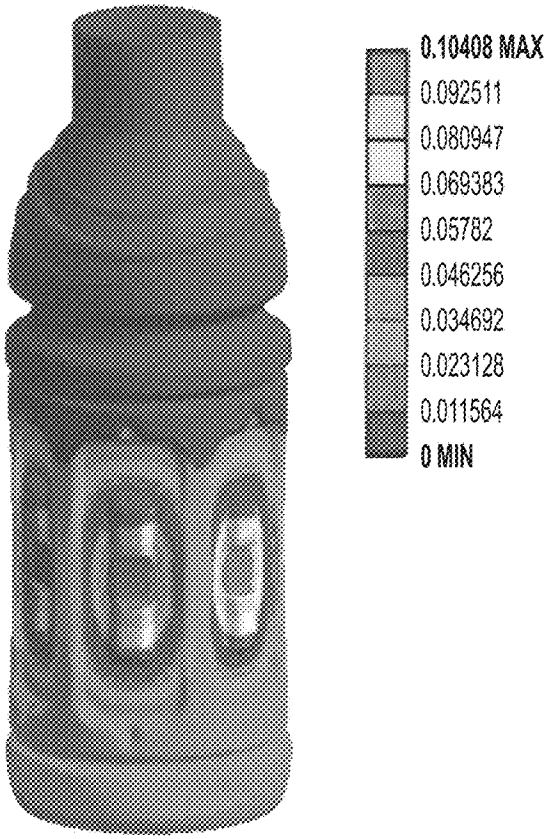
FIG. 10A is an illustration of deformation observed with finite element analysis of an exemplary container of similar configuration as FIG. 7B in accordance with the disclosed subject matter under simulated conditions of container vacuum due to hot filling and cooling.

To demonstrate filled containers having indentations in the longitudinal sides 130*a*, 130*b* of the recessed panels 114 as disclosed would properly compensate for internal vacuum after hot-filling, sealing, and cooling, FEA fluid-filled simulation was conducted using a container having indentations formed in the transition region proximate to the upper and lower transverse ends of the perimeter as well as in the longitudinal sides of the panels. The simulated container and FEA results are presented in FIG. 10B. Full vacuum conditions were reached in the simulation without failure of the container. Further, and for comparison, FIG. 10A shows the results under the same vacuum conditions for a container having indentations only in the transverse ends of the recessed panels as described above with reference to FIG. 1. Hence, the additional indentations in the longitudinal sides of the recessed panels had no detrimental impact on the vacuum performance of the container, yet still provide the same advantages as described above.

Figure 11:
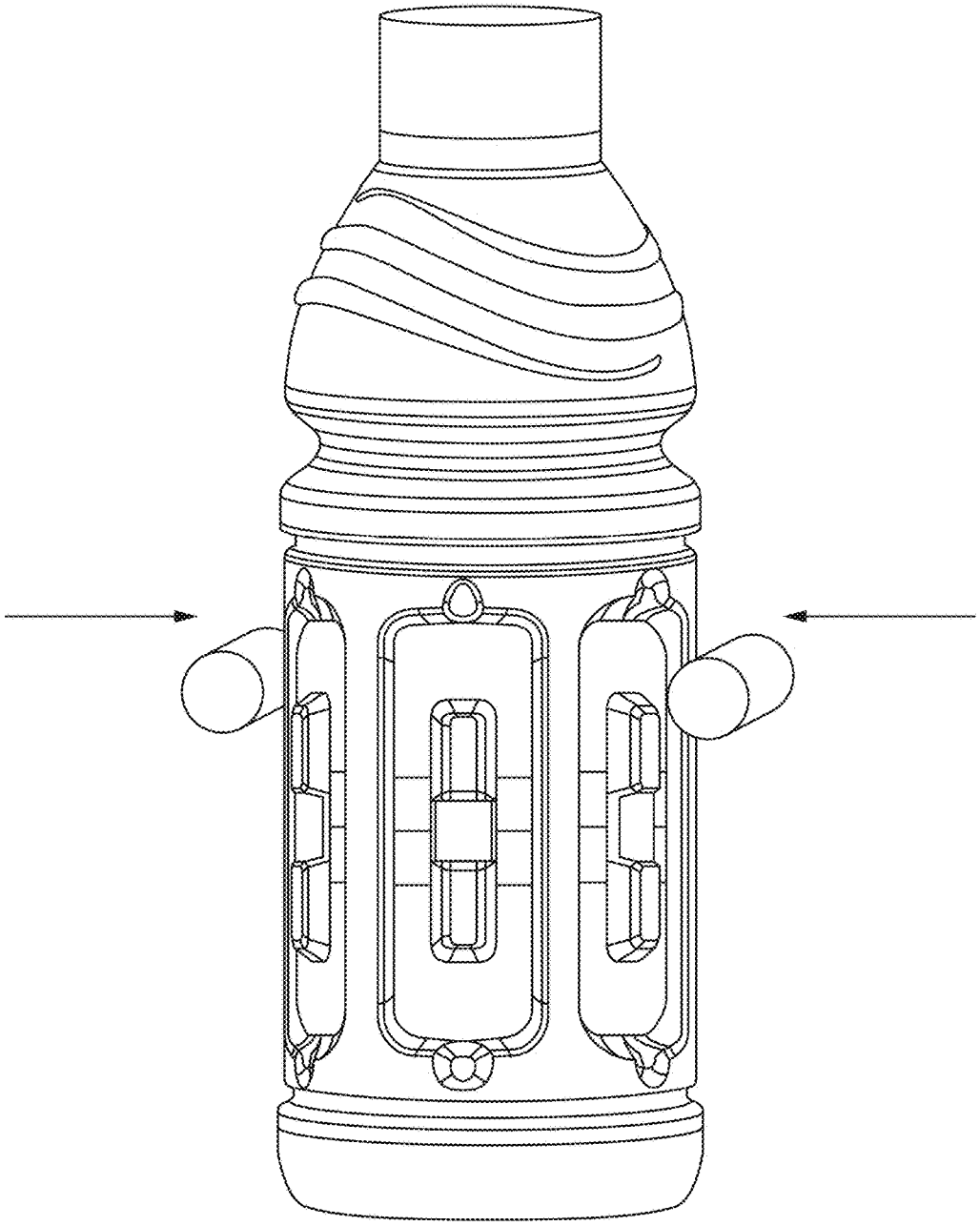
FIG. 11 is an illustration of simulated side load conditions for finite element analysis of sidewall displacement and stress of containers in accordance with the disclosed subject matter.
Figure 12B:
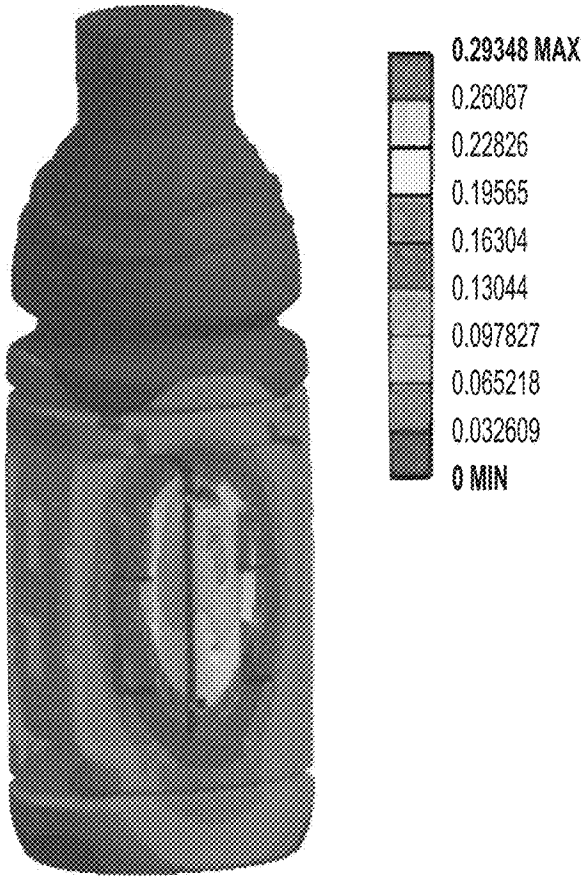
FIG. 12B is an illustration of displacement observed with finite element analysis of an exemplary container further in accordance with the disclosed subject matter and of similar configuration as depicted in FIG. 12A, but with additional indentations in longitudinal sides of panels of the container, under simulated conditions of side load according to the conditions depicted in FIG. 11.
Figure 12A:
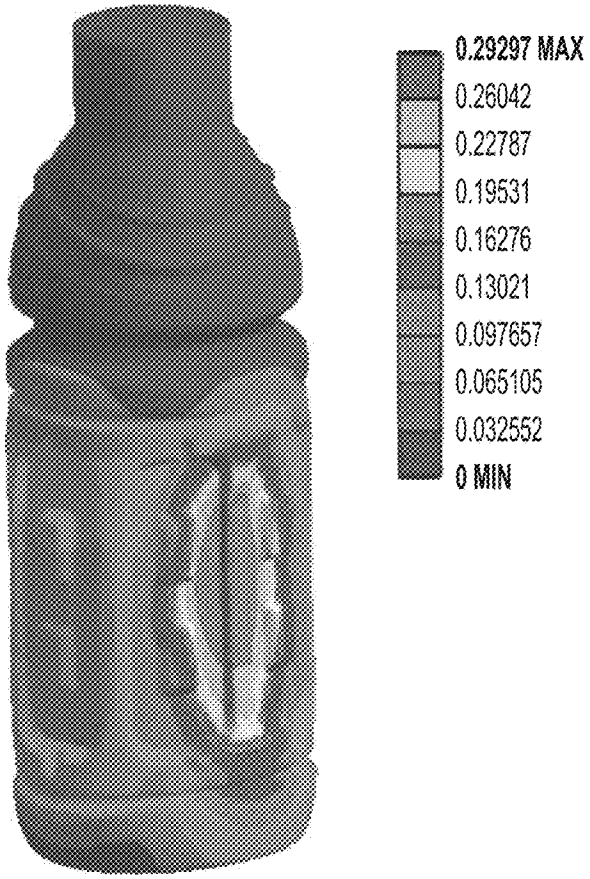
FIG. 12A is an illustration of displacement observed with finite element analysis of an exemplary container having indentations in transverse ends of panels of the container in accordance with the disclosed subject matter under simulated conditions of side load according to the conditions depicted in FIG. 11.
Figure 12D:
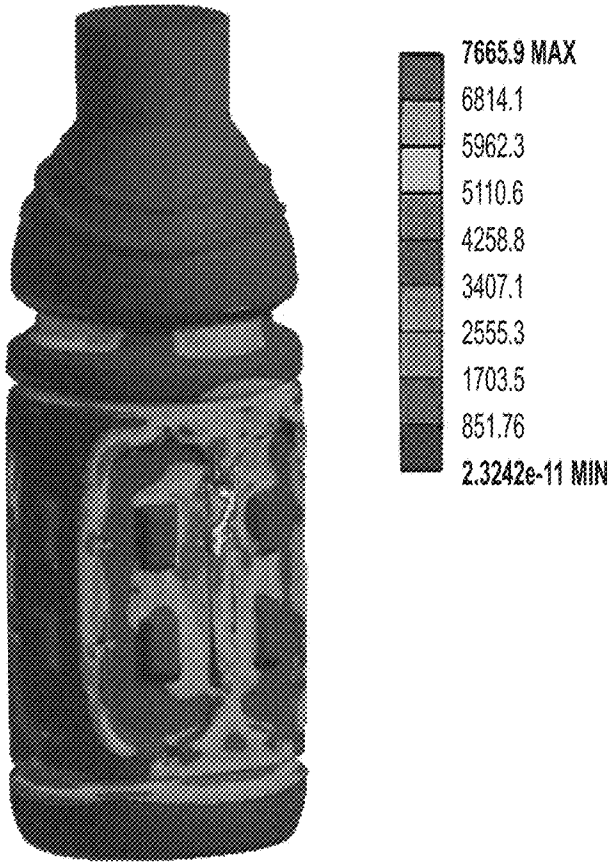
FIG. 12D is an illustration of local sidewall stress observed with finite element analysis of an exemplary container further in accordance with the disclosed subject matter and of similar configuration as depicted in FIG. 12C, but with additional indentations in longitudinal sides of panels of the container, under simulated conditions of side load according to the conditions depicted in FIG. 11.
Figure 12C:
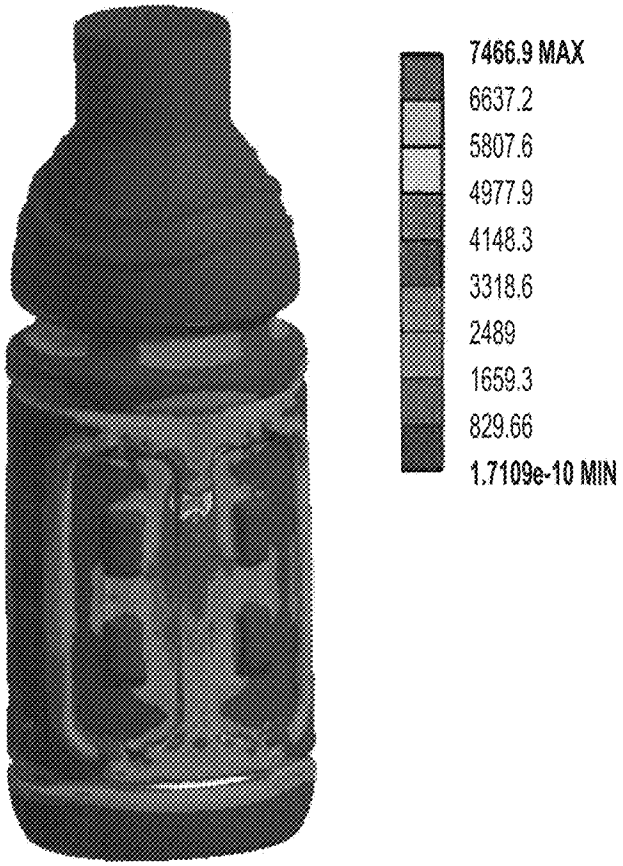
FIG. 12C is an illustration of local sidewall stress observed with finite element analysis of an exemplary container having indentations in transverse ends of panels of the container in accordance with the disclosed subject matter under simulated conditions of side load according to the conditions depicted in FIG. 11.

Side load testing, similar to that described above was also performed on the containers having indentations in the longitudinal sides of the recessed panels. An illustration of the simulated side loads on the container for finite element analysis ("FEA") of sidewall displacement and stress of containers in accordance with the disclosed subject matter is shown in FIG. 11. For the purpose of comparison, FEA side-load simulation results of the displacement observed for a container having indentations only in the transverse ends of the recessed panels and for a container having additional indentations in the longitudinal sides of the recessed panels the are shown in FIG. 12A and FIG. 12B, respectively. Likewise, FEA side-load simulation results of the sidewall stress observed for a container having indentations only in the transverse ends of the recessed panels and for a container having indentations in the longitudinal sides of the recessed panels the are shown in FIG. 12C and FIG. 12D, respectively. As shown by the FEA results of FIGS. 12A-12D, the addition of indentations in the longitudinal sides of the recessed panels no detrimental effect on the side-load performance of the container.

In accordance with another aspect of the disclosed subject matter, a method of forming a hot-fillable container having one or more indentations as described herein is provided. The method includes providing a mold having a surface impression or projection corresponding to the at least one indentation and expanding a parison into the mold to form the container. The mold contains a surface impression to define the indentation. The container can include any features or modifications as described above or otherwise known. It will be understood that the container can be made using any suitable technique, including blow molding, thermoforming, etc. By way of example, and not limitation, the disclosed containers can be made by the methods disclosed in U.S. Pat. Nos. 8,636,944, 8,585,392, 8,632,867, 8,535,599, 8,544,663, and 8,556,621, incorporated herein by reference.

Container embodiments in accordance with the disclosed subject matter are suitable for the manufacture of containers such as, bottles, jars and the like. Such containers can be used with a wide variety of perishable and nonperishable goods. For purpose of understanding, and not limitation, the containers disclosed herein can be filled with liquid or semi-liquid beverages and food products such as sodas, juices, sports drinks, energy drinks, teas, coffees, sauces, dips, jams and the like, and can be suitable for and configured to be filled and re-filled with a hot liquid or non-contact (i.e., direct drop) filler, such as a non-pressurized filler. Containers of the disclosed subject matter can be used for transporting, serving, storing, and/or re-using such products while maintaining a desired shape despite exposure to internal pressure and external loads. The container can have a base configuration and/or side wall features to provide improved sensitivity and controlled deformation from applied forces, for example resulting from pressurized filling, sterilization or pasteurization and resulting thermal expansion due to hot liquid contents and/or vacuum deformation due to cooling of a liquid product filled therein. Examples of such features, which can be incorporated in the container of the disclosed subject matter, are disclosed in International Patent Application No. PCT/US14/011433, hereby incorporated by reference herein in its entirety, as well as U.S. Pat. No. 7,334,695, also incorporated by reference herein in its entirety. For purpose of illustration, and not limitation, reference is made herein to a container that is intended to be hot-filled, and may be re-filled, with a liquid product, such as a carbonated soft drink, tea, sports drink, energy drink or other similar liquid product. The apparatus and methods presented herein can be used for a variety of polymeric containers, having various shapes, sizes and intended uses, such as polymeric containers for liquids, and particularly beverages.

In addition to the specific embodiments claimed below, the disclosed subject matter is also directed to other embodiments having any other possible combination of the dependent features claimed below and those disclosed above. As such, the particular features disclosed herein can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A hot-fillable plastic container comprising:

a container body having an outer surface and defining a longitudinal axis;

at least one recessed panel defined in the container body, the at least recessed one panel having an outer perimeter and recessed relative to the outer surface of the container body, the perimeter including opposing longitudinal sides and transverse ends;

a transition region defined along the perimeter of the recessed panel, the transition region extending between the recessed panel and the outer surface; and at least one indentation formed in the transition region proximate at least one transverse end of the outer perimeter, the indentation having a height, a width, and a depth, the height of the indentation defined between a first end and a second end of the indentation, the first end being disposed in the transition region and the second end being disposed in the outer surface of the container body, wherein the indentation is formed entirely outside of the recessed panel.

2. The container of claim 1, wherein the indentation is tapered such that the height, width, and depth of the indentation increase with increasing distance from the recessed panel to a maximum height, a maximum width, and a maximum depth at the outer surface of the container body.

3. The container of claim 1, wherein the indentation defines a V-shape in the transition region.

4. The container of claim 1, wherein the indentation has an arcuate surface in cross-sectional view.

5. The container of claim 4, wherein a surface of the indentation has a radius of curvature.

6. The container of claim 5, wherein the radius of curvature is between about 0.04 inches and about 0.06 inches.

7. The container of claim 1, wherein the indentation is configured to temporarily deform when the plastic container is subject to an external load.

8. The container of claim 1, wherein the outer surface of the container body has a reduced propensity to permanently deform when subject to an external load relative to a container of a same configuration but without the at least one indentation.

9. The container of claim 1, wherein a ratio of the maximum depth of the indentation to a radius of the container body is between about 0.075 and about 0.15.

10. The container of claim 1, wherein a ratio of the maximum height of the indentation to a height of the container body is between about 0.05 and about 0.15.

11. The container of claim 1, wherein a ratio of the maximum width of the indentation to a radius of the container body is between about 0.10 to about 0.20.

12. The container of claim 1, wherein the indentation is formed as a rounded channel in the transverse end of the transition region.

13. The container of claim 1, wherein the recessed panel comprises a substantially centrally disposed raised portion having a surface co-planar with the outer surface of the container.

14. The container of claim 1, wherein a plurality of the recessed panels are defined in the container body.

15. The container of claim 14, wherein adjacent recessed panels are separated by posts defined by the outer surface of the container body.

16. The container of claim 14, wherein each recessed panel has a respective at least one indentation defined along a perimeter thereof.

17. The container of claim 1, wherein the at least one indentation is formed about midway between the opposing longitudinal sides of the recessed panel.

18. The container of claim 1, further comprising a base, wherein the base comprises a standing ring, a frustroconical nose cone, and a diaphragm portion disposed between the standing ring and the nose cone.

19. The container of claim 1, further comprising a shoulder portion.

20. The container of claim 19, wherein the container body is disposed between the shoulder portion and the base.

21. The container of claim 20, wherein the container body is separated from the shoulder portion by a first circumferential groove and separated from the base portion by a second circumferential groove.

22. The container of claim 1, wherein the at least one indentation comprises a first indentation formed in the transition region proximate a lower transverse end of the outer perimeter and a second indentation formed in the transition region proximate an upper transverse end of the outer perimeter.

23. The container of claim 22, wherein a plurality of the recessed panels are defined in the container body.

24. The container of claim 1, wherein the indentation is configured to fold inwardly when the outer surface of the container body is subject to an external force and to reform substantially to an as-formed configuration when the external force is removed.

25. The container of claim 24, wherein the width of the indentation decreases when the outer surface of the container body is subject to an external force.

26. The container of claim 24, wherein the container is less susceptible to permanent deformation than a container of a same configuration but without the at least one indentation.

27. The container of claim 1, further comprising at least a second indentation formed in the transition region proximate at least one longitudinal side of the outer perimeter.

* * * * *